US009257743B2

(12) United States Patent
Brady

(10) Patent No.: US 9,257,743 B2
(45) Date of Patent: Feb. 9, 2016

(54) SYSTEM AND METHOD FOR PROVIDING A FREQUENCY SELECTIVE RADOME

(71) Applicant: Lockhead Martin Corporation, Bethesda, MD (US)

(72) Inventor: Vernon T. Brady, Orlando, FL (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 314 days.

(21) Appl. No.: 13/770,305

(22) Filed: Feb. 19, 2013

(65) Prior Publication Data

US 2013/0214988 A1 Aug. 22, 2013

Related U.S. Application Data

(60) Provisional application No. 61/599,488, filed on Feb. 16, 2012.

(51) Int. Cl.

| | |
|---|---|
| ***H01Q 1/42*** | (2006.01) |
| ***H01Q 15/00*** | (2006.01) |
| ***H01Q 5/22*** | (2015.01) |

(52) U.S. Cl.

CPC ..... *H01Q 1/422* (2013.01); *H01Q 5/22* (2015.01); *H01Q 15/0013* (2013.01); *Y10T 29/49016* (2015.01)

(58) Field of Classification Search

CPC ..... H01Q 1/422; H01Q 15/0013; H01Q 5/22

USPC ..... 343/872, 909, 700 MS, 873

See application file for complete search history.

(56) References Cited

U.S. PATENT DOCUMENTS

| | | | | |
|---|---|---|---|---|
| 4,358,772 | A | 11/1982 | Leggett | |
| 5,208,603 | A * | 5/1993 | Yee | 343/909 |
| 5,408,244 | A | 4/1995 | Mackenzie | |
| 5,592,186 | A * | 1/1997 | Hoofe et al. | 343/909 |
| 5,600,325 | A * | 2/1997 | Whelan et al. | 342/13 |
| 6,323,825 | B1 * | 11/2001 | Zidek et al. | 343/872 |
| 6,809,608 | B2 | 10/2004 | Fjelstad | |
| 7,688,278 | B2 * | 3/2010 | Frenkel | 343/872 |
| 2009/0109115 | A1 * | 4/2009 | Dittrich et al. | 343/841 |

FOREIGN PATENT DOCUMENTS

| | | |
|---|---|---|
| DE | 4336841 | 5/1995 |

* cited by examiner

*Primary Examiner* — Tho G Phan

(74) *Attorney, Agent, or Firm* — Terry M. Sanks, Esq.; Beusse Wolter Sanks & Maire, PLLC

(57) ABSTRACT

A system including a first dielectric layer comprising a solid material configured to form a first layer of a radome, and a second dielectric layer comprising a solid material configured to form a second layer of the radome. The first dielectric layer and the second dielectric layer are spaced apart to provide an inner gap configured as a third layer of the radome. The inner gap is exclusively filled with a gas. The radome is configured to provide for the radome to be frequency selective. A radome and method are also disclosed.

19 Claims, 3 Drawing Sheets

SYSTEM AND METHOD FOR PROVIDING A FREQUENCY SELECTIVE RADOME

CROSS-REFERENCE TO RELATED APPLICATIONS

This application claims the benefit of U.S. Provisional Application No. 61/599,488 filed Feb. 16, 2012, and incorporated herein by reference in its entirety.

BACKGROUND

Embodiments relate to radome technology and, more particularly, to radome technology which provides for frequency selectivity with reduced signal loss.

A radome is a structural, weatherproof enclosure typically provided to protect a sensor and/or antenna. The radome is constructed of material that minimally attenuates the electromagnetic signal transmitted or received by the antenna and/or sensor. More specifically, the radome is transparent to radar, radio, or infrared waves.

A multimode sensor (semi-active and/or passive infrared ("IR") as well as millimeter-wave radar frequencies ("RF")) generally includes a radome for protection from the environment as well as for band selectivity, such as a radome that can pass IR and some millimeter wavelength signals, and reject other millimeter wave and microwave signals. The radome should have very little effect on the signals that pass through it, while rejecting certain wavelengths (e.g., a particular band of RF signals) to reduce the radar cross section as well as reduce electromagnetic interference reaching the antenna and thus the circuitry of the senor. Additionally, the interior of the body and the sensor circuitry housed in the body is also able to be disrupted by electromagnetic interference ("EMI"), Frequencies near the operating RF are excluded from the normal signal path, just past the antenna, using filters.

Known radomes include those having frequency selective slots which allow the radar signal to pass through while excluding other frequencies. However, this type of radome does not allow for the transmission of IR signals. Another known radome allows both IR and millimeter wave radar signals to be transmitted. To make this type of radome frequency selective, wire grids are inserted between two layers of dielectric material, and the dielectric materials are in direct contact with each other. The surfaces of the two dielectrics that must touch each other are difficult to machine to the tolerance necessary so as not to allow small spaces to appear between the two layers. These small spaces can also cause an interference effect which can spoil the JR image. This radome type is also expensive to manufacture, and the wire grids are known to block some of the IR and millimeter wave signals which increases the signal loss of the radome.

Though current radome technology allows for radomes to be used with multimode sensors Which have semi-active and passive infrared as well as millimeter-wave radar, manufacturers and users of systems utilizing such multimode sensors would benefit from a radome which reduces signal loss attributed to structure of the radome while also reducing costs associated with the manufacture of such radomes.

SUMMARY

Embodiments relate to a system and a method for providing a frequency selective radome, and to a radome. The system comprises a first dielectric layer comprising a solid material configured to form a first layer of a radome, and a second dielectric layer comprising a solid material configured to form a second layer of the radome. The first dielectric layer and the second dielectric layer are spaced apart to provide an inner gap configured as a third layer of the radome. The inner gap is exclusively filled with a gas. The radome is configured to provide for the radome to be frequency selective.

The radome comprises a first dielectric layer or plate comprising a solid material, a second dielectric layer or plate comprising a solid material, and an inner gap formed between the first dielectric layer or plate and the second dielectric layer or plate. A thickness of the gap is determinative of a selective transmission of a desired millimeter wavelength passband.

The method comprises determining thicknesses of a first dielectric layer and a second dielectric layer of a radome with a simulation device based on wavelengths to be transmitted and a respective dielectric constant for each layer. The method also comprises determining a distance for an inner gap between the first dielectric layer and the second dielectric layer of the radome with the simulation device to allow a desired infrared signal and millimeter-wave signal to pass through the radome based on the properties of the first dielectric layer and the second dielectric layer and the separation distance. The method also comprises configuring the radome to have the determined distance for the inner gap between the first dielectric layer and the second dielectric layer, each with the determined thickness.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
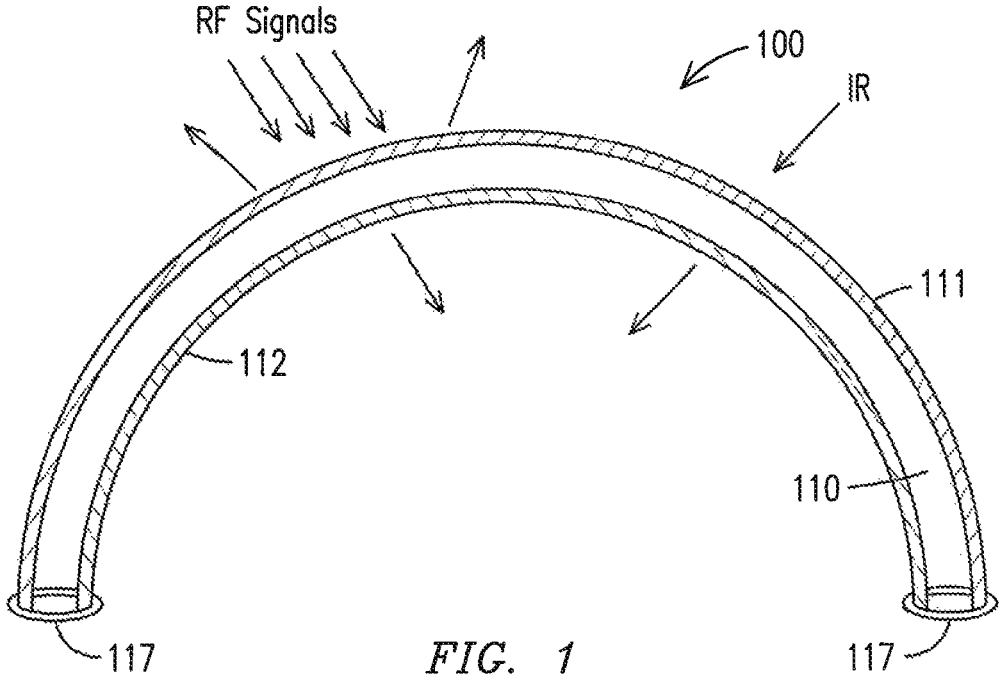
FIG. 1 shows an embodiment of a frequency selective radome.

Disclosed embodiments are described with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with an embodiment.

Notwithstanding that the numerical ranges and parameters setting forth the broad scope of aspects of an embodiment are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

FIG. 1 is a depiction of an embodiment of a frequency selective radome. The radome 100 is shown being transmissive to IR, reflecting some RF band signals, and transmitting other RF band signals. Radome 100 is shown including a first dielectric layer or plate 111 comprising a solid material and a second dielectric layer or plate 112 comprising a solid material. As used herein, the terms "layer," "plate," and "layer/plate" may be used interchangeably. There is no need for the first dielectric layer 111 and second dielectric layer 112 to be the same material, nor the first dielectric layer 111 and second dielectric layer 112 to have about the same dielectric constant.

The radome 100 may have a gap 110 formed between the first dielectric layer/plate 111 and the second dielectric layer/plate 112. The gap is provided to create a separation between the first dielectric layer/plate and the second dielectric layer/plate so that each layer/plate does not come into contact with the other. The two relatively thin dielectric layers/plates 111 and 112 separated by the inner gap 110 have been found to allow for the transmission of several IR wavelengths as well as millimeter waves.

Figure 4:
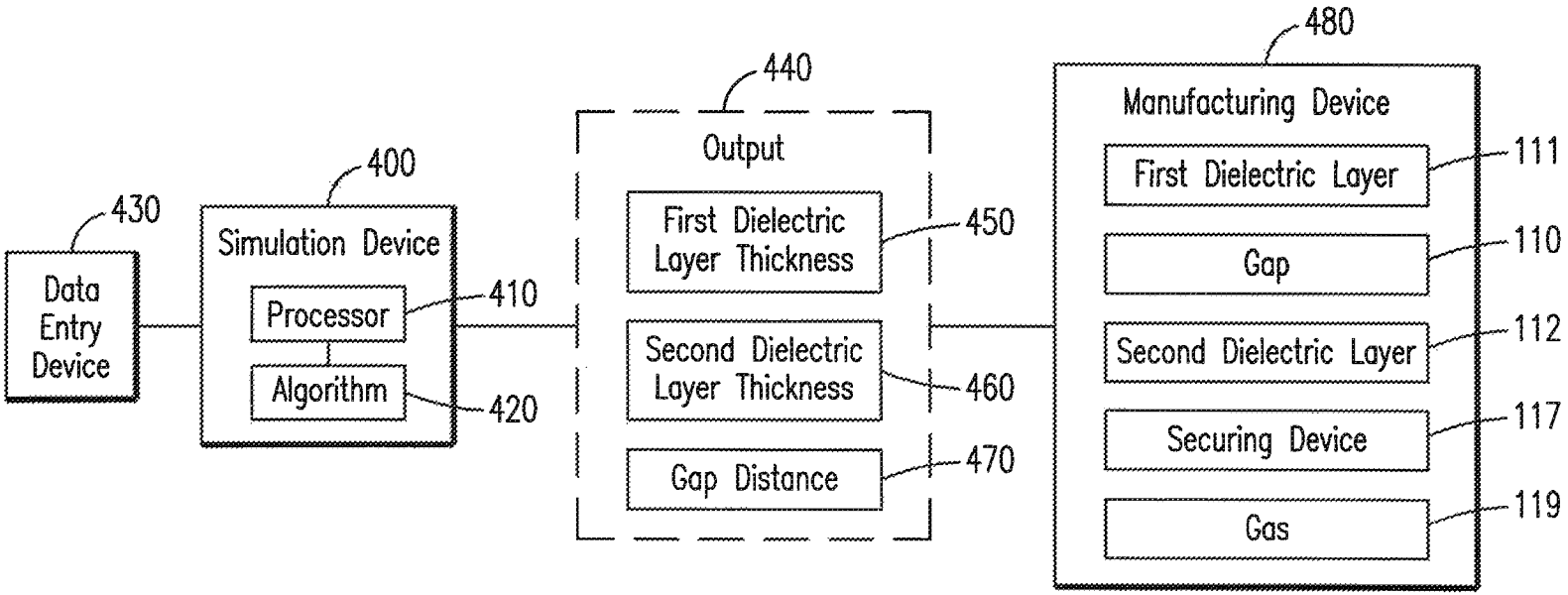
FIG. 4 shows a block diagram representing components used in a method of an embodiment.

The gap is provided as a low dielectric constant material. The inner gap 110 is exclusively filled with a gas 119 (as illustrated in FIG. 4), typically air. Other non-limiting examples of a gas which may be used include, but is not limited to, argon, nitrogen, and any other dry (or natural) gas that does not react with the material making up the first dielectric layer 111 or the second dielectric layer 112. In another non-limiting example, no gas may be used, but instead a vacuum is created within the gap 110. Since the term "gap" is used to describe a separation between the first dielectric layer 111 and the second dielectric layer 112, other terms are also applicable in describing this element, such as, but not limited to, "a separation," "space," or "void." Additionally, though the term "filled" is used, this term is not meant to mean that the gap is completely filled with a gas. This term is used to mean that gas is placed within. Furthermore, other terms may be used, such as, but not limited to, "positioned."

The first dielectric layer 111 and the second dielectric layer are shown held together by a securing device 117, such as but not limited to base rings. Supports to maintain the air (or other gas filled) gap 110 are not shown because in the embodiment shown the respective dielectrics 111, 112 are plates are sufficiently mechanically strong to not need supports. Any supports (or connections passing from the first dielectric layer to the second dielectric layer) used, however, may result in no obstructions within the gap 110 which may affect IR and/or millimeter wave signals which may increase signal loss of the radome. In an embodiment, the radome, as disclosed herein, may be formed on top of a dome shaped structure that provides a substrate for the radome, and formed from a broadband transmissive material.

The radome made of one such material which is sufficiently mechanically strong to not need supports is a zinc sulfide-based material CLEARTRAN™ provided by Edmund Optics, Inc. Barrington, N.J., which is currently used on missiles. CLEARTRAN™ has a thickness of about 6 mm, with an infrared transmission range of between about 0.37 to 13.5 μm, as well transmission for some RF bands including the Ka band. The plates 111, 112 are shown hemispherically, or spherically, shaped. The base rings 117 hold the dielectric plates 111 and 112 at their ends.

Applying the embodiments disclosed herein have been found to improve the performance of a radome by removing the transmission losses associated with the foam or the other dielectric layers that are used to make the known prior art radomes wide band. The embodiments disclosed herein also allow the layer/plate "sandwich" to be a much narrower band pass structure as compared to any prior art multi-layer radomes.

In an embodiment a frequency selective radome may be provided, which allows reception of a band of microwave/RF radar signals and IR signals, with a minimum of loss, while rejecting (reflecting) other microwave/RF signal wavelengths. The radome may comprise a sandwich configuration which utilizes a gap as the low dielectric constant material between the high dielectric constant materials. Thus, the high dielectric constant layers/plates selected to be IR transmissive for passing IR wavelengths are separated by a dielectric that is entirely air or another gas. The air (or other gas) alone fills the gap between the high dielectric constant layers/plates which has been found to allow selective transmission of the desired millimeter wavelength passband.

The dielectric constants for the high dielectric constant material are those which generally have dielectric constants in the range of about 3.5 to 10, such as, but not limited to, 4 to 9. Some of these materials are well known in the art. The thicknesses of the high-dielectric constant layers/plates are determined by the wavelengths to be transmitted and the dielectric constant of the material, such as by using a simulation device (running simulation software such as, but not limited to, RASCR™), and plugging in desired performance characteristics. Though the simulation device is disclosed as utilizing RASCR™ software, other simulators may be used, such as, but not limited to, an optic simulator, an electromagnetic simulator, a millimeter-wave simulator, high frequency structure simulator ("HFSS"), etc. As a non-limiting example, the layers/plates of high dielectric constant material may generally range in thickness from about 0.05 inches to 0.25 inches, The gap, filled by air or another gas, has a thickness generally in a range from about 0.05 inches to about 0.4 inches. The precise gap may also be set by the simulation device. By making the air dielectric thicker than $\lambda/4$ ($\lambda$ of the microwave/RF passband, where $\lambda$ is a wavelength), the passband response of the radome can be narrowed. Thus, it is evident that the thickness of the gap is relative to the passband.

Having a gap with a gas provides for an inner low dielectric constant material which avoids a need for inner bonding and machining of the inner layer. The four dielectric surfaces, comprising inner and outer surfaces on both higher dielectric constant layers/plates, can be machined and polished for good IR performance, and do not have to be bonded to some inner solid dielectric or porous dielectric material.

In an embodiment, the radome may be further provided with one or more protective outer surface coatings for certain environmental conditions, without destroying the desired transmission characteristics of the radome. Moreover, although embodiments described above have all had a three layer sandwich structure, a radome with more layers/plates than the three disclosed above is possible, such as, but not limited to, five layers/plates including two air gaps and three high dielectric constant layers/plates. However, the passband has been found to generally be narrower with additional pairs of high and low dielectric layers/plates, and the loss a bit higher as well.

Figure 2:
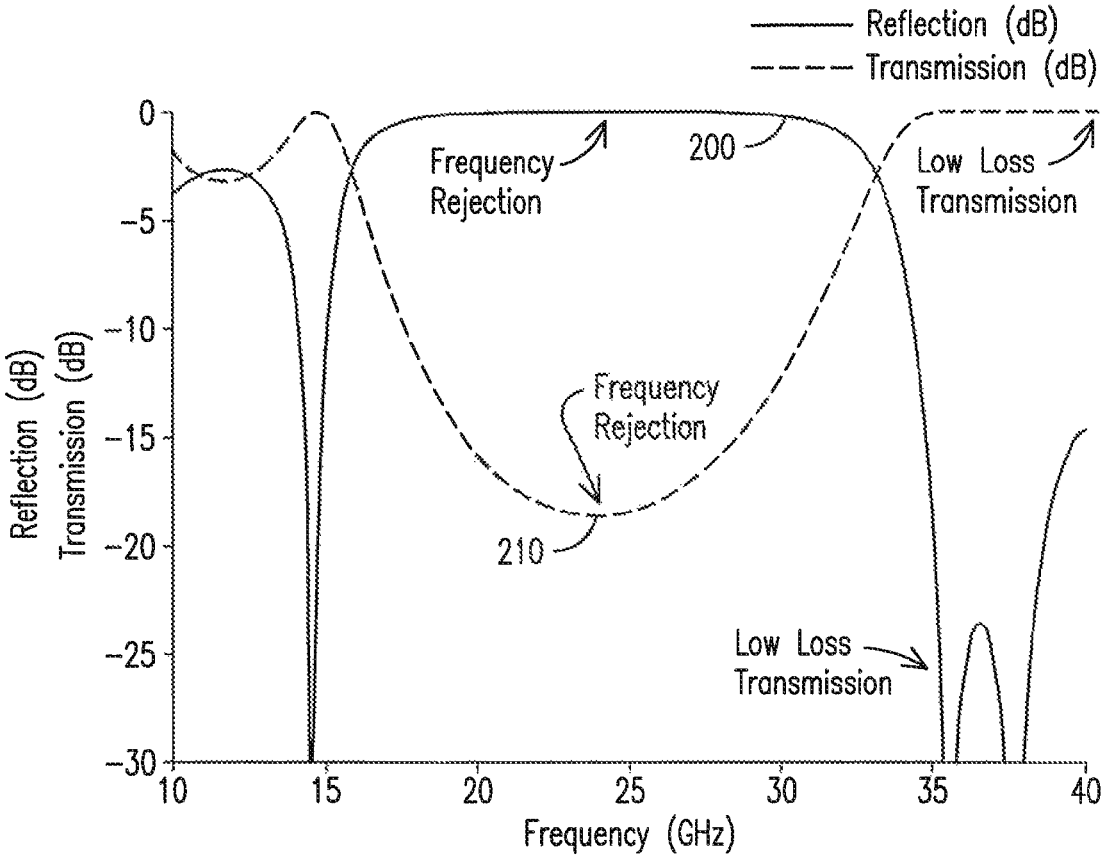
FIG. 2 shows an embodiment of a simulated reflection and transmission (in dB) response for a disclosed frequency selective radome.

FIG. 2 shows an embodiment of a simulated reflection and transmission (in dB) response for a disclosed frequency selective radome. More specifically, a simulated reflection and transmission (in dB) response at 25° C. for a disclosed frequency selective radome in the frequency range from 10 GHz to 40 GHz is shown. FIG. 2 should not be construed as limiting the scope or content of an embodiment in any way. A first line 200 shows the reflection and a second line 210 shows the transmission of the radome. The radome characteristics simulated included dielectric layers/plates having a dielectric constant for the high dielectric constant plates of 8.67@35 GHz, dielectric plate thickness 0.135 inches, and a low dielectric layer (air) thickness of 0.250 inches. To establish these characteristics, a simulation device used CLEARTRAN™ coefficients. In regions of very low reflection (<−20 dB) there can be seen to be a good match to the frequency signals at that frequency. The transmission loss is very good (low) both above 35 GHz and below 15 GHz. Frequency rejection occurs between about 15 GHz and 30 GHz.

Figure 3:
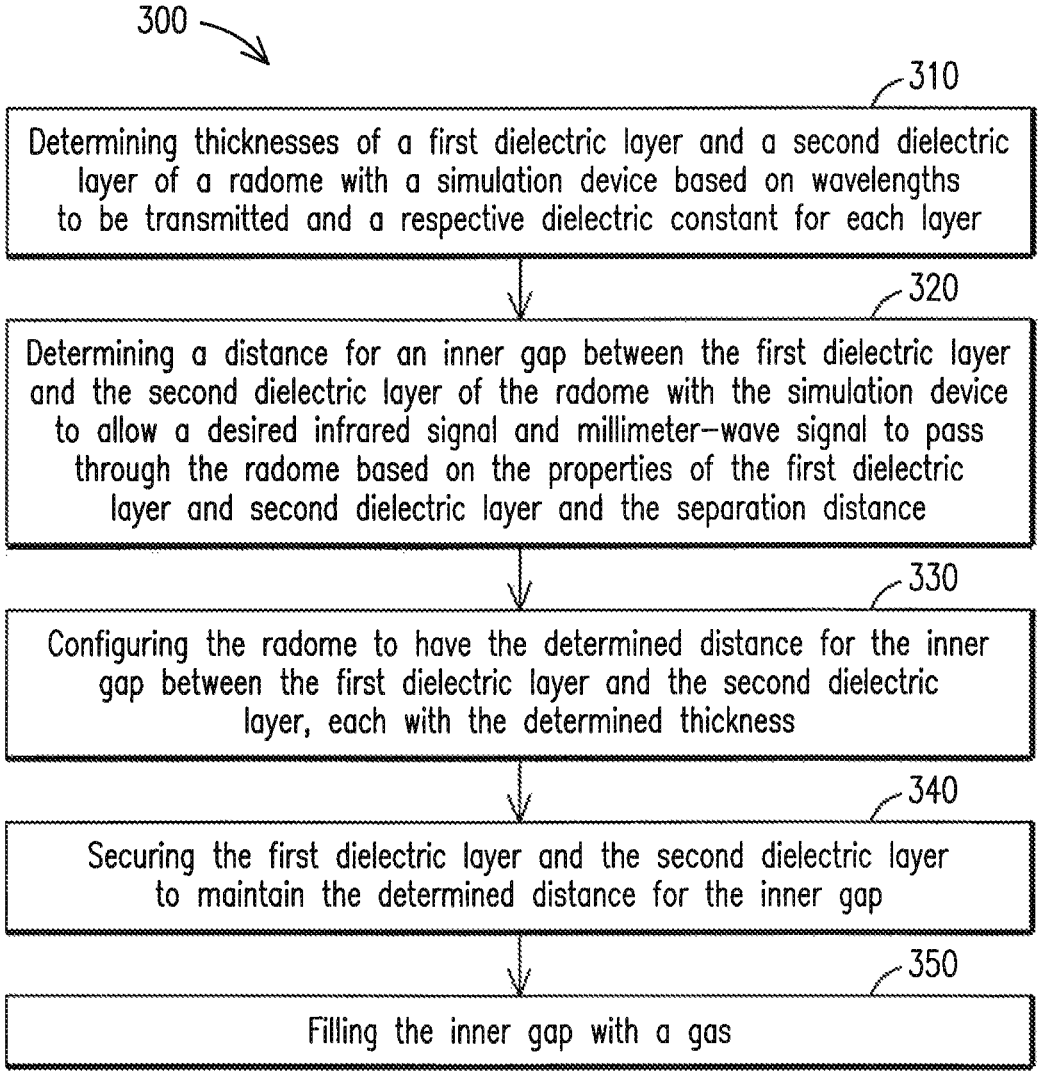
FIG. 3 shows a flowchart of a method of an embodiment.

FIG. 3 is a flowchart illustrating a method for providing frequency selectivity in a radome. The method 300 comprises determining thicknesses of a first dielectric layer and a second dielectric layer of a radome with a simulation device based on wavelengths to be transmitted and a respective dielectric constant for each layer, at 310. The method further comprises determining a distance for an inner gap between the first dielectric layer and the second dielectric layer of the radome with the simulation device to allow a desired infrared signal and millimeter-wave signal to pass through the radome based on the properties of the first dielectric layer and the second dielectric layer and the separation distance, at 320. The method also comprises configuring the radome to have the determined distance for the inner gap between the first dielectric layer and the second dielectric layer, each with the determined thickness, at 330. The method may also comprise securing the first dielectric layer and the second dielectric layer to maintain the determined distance for the inner gap, at 340. The method may also comprise filling the inner gap with a gas, at 350. The dielectric constant of the gas to be used will be incorporated, or used, in the determining the distance of the inner gap. Determining the distance for the inner gap, at 320, may further comprise determining the distance to reflect certain wavelength signals to reduce radar cross section and/or electromagnetic interference.

In another embodiment, instead of filling the inner gap with a gas, a vacuum may be created in the inner gap. When the vacuum is created, securing the first dielectric layer and the second dielectric layer, at 340, may further comprise sealing the inner gap to maintain the vacuum.

FIG. 4 shows a block diagram representing components used in a method of an embodiment. A simulation device 400 is disclosed. The simulation device may be a computing system. Thus, the simulation device 400 may have a processor 410 Which is used to process an algorithm 420, such as, but not limited to, an algorithm specific to performing a simulation to determine thicknesses of the first dielectric layer and second dielectric layer and a distance for an inner gap between the first dielectric layer and the second dielectric layer, as discussed above. A data entry port 430 may also be available. The data entry port 430, such as, but not limited to, a keyboard, may be used to communicate wavelengths to be transmitted, a respective dielectric constant for each layer, and/or the desired infrared signal and millimeter-wave signal to pass through the radome. An output 440 from the simulation device 400 is provided. The outputs may include thicknesses for each dielectric layer 450, 460 and the distance for the inner gap 470. A manufacturing device 480 may be available to manufacture the radome, such as, but not limited to, being able to configure the dielectric layers 111, 112 with the desired gap 110 between the layers 111, 112. The manufacturing device 480 may also be operable to position the securing device 117 so that the layers 111, 112 are held securely in place. The manufacturing device 480 may also be configured to insert the gas 119 into the gap 110. In another embodiment, the manufacturing device 480 may be configured to create a vacuum within the gap 110, wherein the securing device may be further configured to create a closed seal for the gap 110.

Thus, as disclosed above, in an embodiment the frequency selective radome comprises multiple layers of dielectric materials configured to allow passage of both infrared (IR) and high frequency (millimeter wavelength) radar with a minimum of loss, while reflecting other wavelengths. The thicknesses of the dielectric layers are determined by the wavelengths to be transmitted and the dielectric constant of the materials. The radome may have the higher dielectric constant layers selected to be IR transmissive to pass IR wavelengths separated by an air (or other gas filled) gap which provides the lower dielectric constant material, where the air or gas filled gap allows the selective transmission of the millimeter wavelengths.

While various disclosed embodiments have been described above, it should be understood that they have been presented by way of example only, and not as a limitation. Numerous changes to the disclosed embodiments can be made in accordance with the specification herein without departing from the spirit or scope of an embodiment. Thus, the breadth and scope of this specification should not be limited by any of the above described embodiments. Rather, the scope of this specification should be defined in accordance with the following claims and their equivalents.

Although disclosed embodiments have been illustrated and described with respect to one or more implementations, equivalent alterations and modifications will occur to others skilled in the art upon the reading and understanding of this specification and the annexed drawings. While a particular feature may have been disclosed with respect to only one of several implementations, such a feature may be combined with one or more other features of the other implementations as may be desired and advantageous for any given or particular application.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this specification and the embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Furthermore, while embodiments have been described with reference to various embodiments, it will be understood by those having ordinary skill in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments Ming within the scope of the appended claims are considered. Moreover, unless specifically stated, any use of the terms first, second, etc., does not denote any order or importance, but rather the terms first, second, etc., are used to distinguish one element from another.

I claim:

1. A system, comprising:

a first hemisphericallv shaped dielectric plate comprising a solid material configured to form a first layer of a radome, the first plate having a hemispherically shaped inner surface and a hemispherically shaped outer surface;

a second hemispherically shaped dielectric plate comprising a solid material configured to form a second layer of the radome, the second plate having a hemispherically shaped inner surface and a hemispherically shaped outer surface; and a void corresponding to separation between the hemispherically shaped inner surface of the first plate and the hemispherically shaped inner surface of the second plate, the separation having a distance determined to reflect certain wavelength signals to reduce radar cross section and/or electromagnetic interference;

wherein the void being configured as a third layer of the radome and is exclusively filled with a gas; and wherein the radome is configured to be frequency selective.

2. The system of claim 1, wherein the gas is at least one of air, argon, nitrogen, and a dry gas that does not react with material of the first dielectric plate and the second dielectric plate.

3. The system of claim 1, wherein the radome provides a microwave passband and the separation is thicker than $\lambda/4$ relative to the microwave passband where $\lambda$ is the microwave wavelength.

4. The radome of claim 1, wherein the first dielectric plate and the second dielectric plate each comprises a plate that has a constant dielectric constant throughout.

5. The system of claim 1, wherein the first plate and the second plate comprise ends; and further comprising a securing device to hold ends of the first plate from the second plate in space relation wherein the first plate and the second plate do not contact each other.

6. A radome, comprising:

a first dielectric layer comprising a solid material, the first layer being hemispherically shaped;

a second dielectric layer comprising a solid material, the second layer being hemispherically shaped and being in space relation from the first layer; and a hemispherically shaped inner gap corresponding to space formed between the first dielectric layer and the second dielectric layer;

wherein a thickness of the inner gap is determinative of a selective transmission of a desired millimeter wavelength passband; and the first and second layers are not attached to dielectric material in the inner gap.

7. The radome according to claim 6, wherein the inner gap is exclusively filled with a gas.

8. The radome of claim 7, wherein the gas is at least one of air, argon, nitrogen, and a dry gas that does not react with the solid material of the first dielectric layer and the solid material of the second dielectric layer.

9. The radome according to claim 6, wherein the inner gap is unobstructed by any other structure connected between the first dielectric layer and the second dielectric layer.

10. The radome of claim 6, wherein the radome provides a microwave passband and the inner gap is thicker than $\lambda/4$ relative to the microwave passband where $\lambda$ is the microwave wavelength.

11. The radome of claim 6, wherein the first dielectric layer and the second dielectric layer each comprises spherical shaped plates that have a constant dielectric constant throughout.

12. The radome of claim 6, wherein the inner gap is a vacuum with no gas and sealed.

13. The radome of claim 6, wherein the first layer and the second layer comprise ends; and further comprising a securing device to hold the ends of the first layer from the second layer in space relation wherein the first plate and the second plate do not contact each other.

14. A radome, comprising:

a first dielectric plate comprising a solid material, the first plate having an inner surface and an outer surface;

a second dielectric plate comprising a solid material, the second plate having an inner surface and an outer surface; and a securing device to hold the first plate at a distance from the second plate in space relation which forms an inner gap between the inner surface of the first plate and the inner surface of the second plate;

wherein the distance being determined to reflect certain wavelength signals to reduce electromagnetic interference; and wherein the inner gap has no supports with respect to the inner surface of the first plate and the inner surface of the second plate.

15. The radome of claim 14, wherein the inner surfaces of the first and second plates are not attached to a dielectric material and do not contact each other.

16. The radome of claim 14, wherein the first plate and the second plate are made of zinc sulfide-based material.

17. The radome of claim 14, wherein the first dielectric plate is hemispherically shaped; the second dielectric plate is hemispherically shaped; and the inner gap is hemispherically shaped.

18. The radome of claim 14, wherein the inner gap is a vacuum with no gas and is sealed.

19. The radome of claim 14, wherein the inner gap is exclusively filled with a gas.

* * * * *

UNITED STATES PATENT AND TRADEMARK OFFICE

CERTIFICATE OF CORRECTION

PATENT NO. : 9,257,743 B2
APPLICATION NO. : 13/770305
DATED : February 9, 2016
INVENTOR(S) : Vernon T. Brady It is certified that error appears in the above-identified patent and that said Letters Patent is hereby corrected as shown below:

In the Claims

Column 7, claim 1, line 20, delete "hemisphericallv" and insert --hemispherically--.

Signed and Sealed this
Third Day of May, 2016

Michelle K. Lee

Michelle K. Lee
*Director of the United States Patent and Trademark Office*